United States Patent [19]

Huyssen

[11] 4,105,231

[45] Aug. 8, 1978

[54] CHAIN LOCK ASSEMBLY

[76] Inventor: Phillip H. Huyssen, 116 Baber St., Hot Springs, Ark. 71901

[21] Appl. No.: 688,153

[22] Filed: May 20, 1976

[51] Int. Cl.[2] ..... E05C 17/36

[52] U.S. Cl. ..... 292/264

[58] Field of Search ..... 292/303, 264, 87, 152

[56] References Cited

U.S. PATENT DOCUMENTS

| | | | |
|---|---|---|---|
| 419,846 | 1/1890 | Gamble | 292/303 |
| 467,165 | 1/1892 | Gravdeman | 292/264 |
| 1,492,030 | 4/1924 | Grah | 292/264 |
| 2,867,468 | 1/1959 | Bugge | 292/264 |
| 3,339,963 | 9/1967 | Chambers | 292/264 |
| 3,381,992 | 5/1968 | Friesen | 292/87 |

*Primary Examiner*—Richard E. Moore

*Attorney, Agent, or Firm*—Tilton, Fallon, Lungmus & Chestnut

[57] ABSTRACT

A chain lock assembly for securing a door in a partially open position including a keeper bracket, a slide bracket, a chain having one end secured to the keeper bracket, a bolt connected to the other end of the chain, and a bolt retainer. The keeper bracket is attached to a frame of the door and the slide bracket is attached to the door adjacent the keeper bracket. The bolt retainer includes a base member for attachment to the door and a resilient finger member integral with the base member for retaining the bolt within the slide bracket of the chain lock assembly.

2 Claims, 4 Drawing Figures

CHAIN LOCK ASSEMBLY

BACKGROUND

The present invention relates to a chain lock and more particularly to a chain lock assembly for securing a door in a partially open position.

A common chain lock assembly presently commercially available includes a length of chain having one end secured to a keeper bracket which can be attached to a door frame and the other end connected to a bolt for engagement with a slide bracket which can be attached to a door. The slide bracket usually includes an elongated slot for slidably receiving the bolt having an enlarged opening in one end to facilitate introduction of the bolt into the slot. A door equipped with a common chain lock assembly can usually be opened to a limited extent depending on the length of the chain when the bolt is in the end of the elongated slot remote from the enlarged opening.

The conventional chain lock assembly is designed to protect the occupants of a room, apartment, or home while the occupants are inside. The unfortunate experience of many has demonstrated that less than complete protection is provided, however, because a skilled intruder can sometimes slide the bolt along the elongated slot and through the enlarged opening by means of certain tools such as wires to gain access to the interior once the door has been opened the limited amount permitted by the chain. The chain can be shortened so that the door can be opened only slightly in an effort to avoid the problem of unauthorized entry. However, the occupants then find it difficult to open the door sufficiently to identify and speak with others on the outside. Accordingly, it has not been possible to enjoy maximum protection from the conventional chain lock assembly without unnecessarily limiting the otherwise significant utility of such devices.

The many advantages of the conventional chain lock assembly have lead to a search for ways to overcome the vexing problem of possible unauthorized entry by intruders. The result has been a number of structures such as those disclosed in U.S. Pat. Nos. 467,165; 1,492,030; and 3,155,410, but such structures have generally been complicated, unsuited for use with conventional chain lock assemblies, or simply inoperative. The present invention represents a distinct improvement in a simple, inexpensive bolt retention means which can quickly and easily be installed for use with any conventional chain lock assembly to effectively prevent unauthorized entry by intruders.

SUMMARY

The present invention includes an improved bolt retention means for use with a conventional chain lock assembly for securing a door in a partially open position. A chain lock assembly normally includes a keeper bracket for attachment to the door frame, a chain having one end secured to the keeper bracket, a bolt connected to the other end of the chain, and a slide bracket for attachment to the door having an elongated slot for slidably receiving the bolt with an enlarged opening in one end thereof to facilitate introducing the bolt into the slot. The novel bolt retention means of the present invention includes a base member for attachment to the door near the end of the elongated slot adjacent the enlarged opening and a resilient finger member integral with the base member extending away from the opening into the slot.

The present invention therefore retains the advantages inherent in conventional chain lock assemblies while adding the additional advantage of preventing unauthorized entry by intruders. The bolt retention means normally prevents the release of the bolt from the elongated slot by blocking access to the enlarged opening. The resilient finger member is preferably slightly bent with a first portion extending away from the enlarged opening into the elongated slot and a second portion extending along the slot to obstruct the path of movement of the bolt along the slot as it is moved toward the opening. The resilient finger member must be manually depressed at the same time the bolt is moved toward disengagement in order to release the bolt from the slide bracket making it virtually impossible for an intruder to manipulate the chain lock assembly from outside.

It is therefore an object of the present invention to provide a bolt retention means for use with a conventional chain lock assembly to prevent unauthorized entry by intruders. The provision of the structure and the realization of the advantages derived therefrom constitute additional important objects of this invention. Other objects of the present invention can be appreciated from the details of construction and operation set forth in the accompanying specifications, claims and drawings.

DRAWINGS

The invention is described in conjunction with the accompanying drawings in which.

DESCRIPTION

Figure 1:
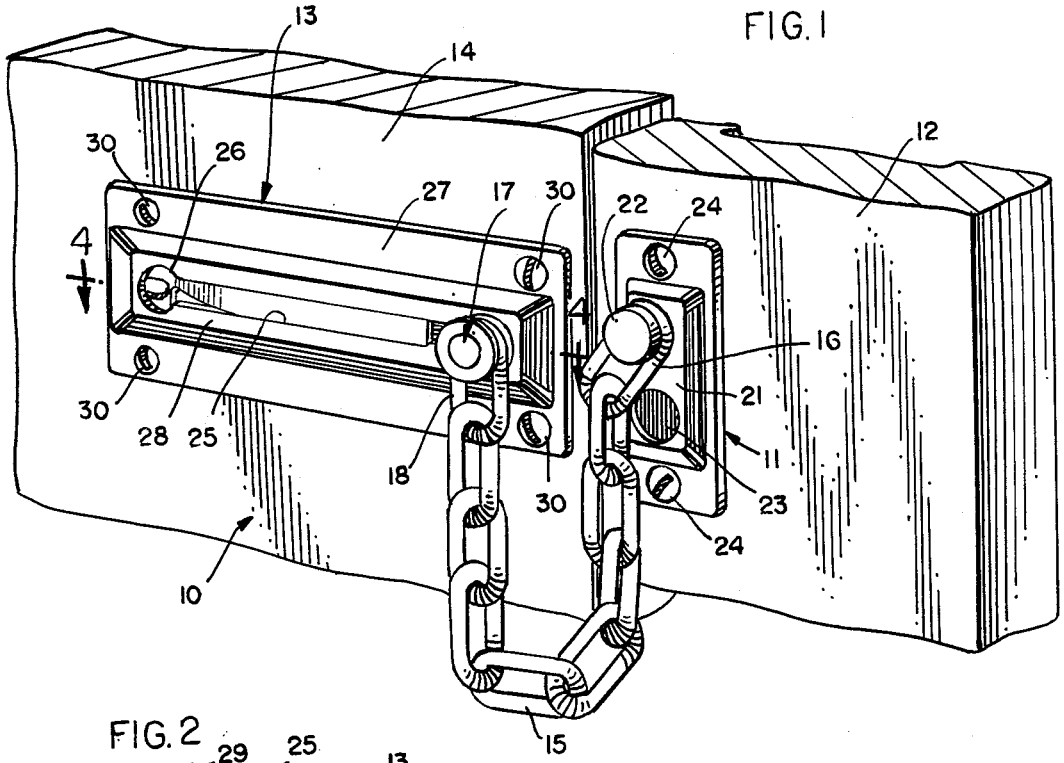
FIG. 1 is a fragmentary perspective view of a door and a door frame illustrating a conventional chain lock assembly equipped with the bolt retention means of the present invention.

In the illustration given and with reference first to FIG. 1 the numeral 10 designates generally a conventional chain lock assembly. The chain lock assembly 10 includes a keeper bracket 11 for attachment to a door frame 12 and a slide bracket 13 for attachment to a door 14. A chain 15 is provided to operatively connect the keeper bracket 11 to the slide bracket 13 at selected times for securing the door 14 in a partially open position.

Figure 4:
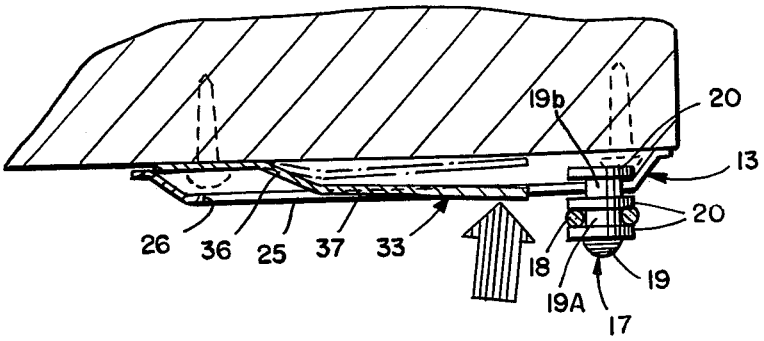
FIG. 4 is a cross-sectional view of the slide bracket, bolt, and bolt retention means taken along the line 4—4 in FIG. 1.

The chain 15 includes a terminal link 16 at one end for attachment to the keeper bracket 11. A bolt 17 is connected to the other end of the chain 15 at the terminal link 18. The bolt 17 includes a shank 19 and discs 20 (as shown in FIG. 4) to cooperate with the terminal link 18 of the chain 15 and with the slide bracket 13. The discs 20 are preferably integral with the shank 19 to define shank segment **19*a* for permanently receiving the terminal link 18 and shank segment 19*b* for slidably receiving the slide bracket 13**.

Referring again to FIG. 1, the keeper bracket 11 preferably includes a raised portion 21 to receive a fastener 22 passing through the terminal link 16 to secure the chain 15 to the keeper bracket 11. The fastener 22 can be any conventional fastener capable of permanently securing the chain 15 to the keeper bracket 11. The raised portion 21 of the keeper bracket 11 also can desirably include an aperture 23 for receiving the bolt 17 when the chain lock assembly 10 is not in use. The aperture 23 has a diameter slightly greater than the diameter of the discs 20 in order to insert the bolt 17 into the raised portion 21 of the keeper bracket 11. The disc 20 of the bolt 17 remote from the terminal link 18 of the chain 15 will normally be inserted through the aperture 23 so that the bolt 17 can hang from the keeper bracket 11 on the shank portion 19*b*. The keeper bracket 11 is, of course, normally attached to the door frame 12 by using at least two screws 24 located about the perimeter of the bracket 11.

The slide bracket 13 includes an elongated slot 25 for slidably receiving bolt 17. The elongated slot 25 has an enlarged opening 26 in one end to facilitate introducing the bolt 17 into the slot 25. The opening 26 will have a diameter slightly greater than the diameter of the discs 20 and the slot 25 will have a width less than the diameter of the discs 20 and slightly greater than the diameter of the shank portion 19*b*. The disc 20 remote from the terminal link 18 of the chain 15 can therefore be introduced into the opening 26 so that the shank portion 19*b* can slide along the slot 25. Accordingly, the disc 20 remote from the terminal link 18 of the chain 16 slides behind the slot 25 and the next adjacent disc 20 slides in front of the slot 25 to serve as a guide for the shank portion 19*b* for confined movement of the bolt 17 along the slot 25.

Figure 2:
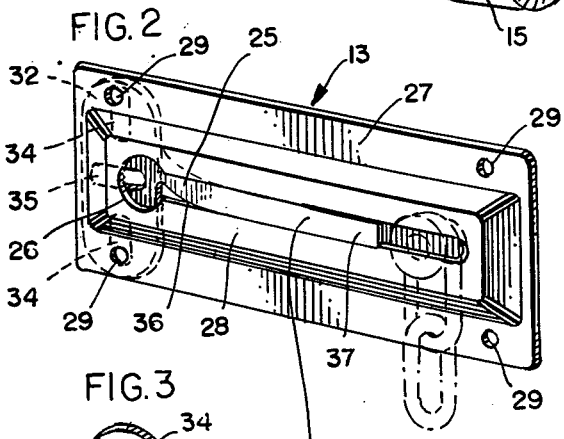
FIG. 2 is a perspective view of the slide bracket of the chain lock assembly illustrated in FIG. 1 with a portion of the chain and the bolt in phantom and with the bolt retention means partially in phantom.

The slide bracket 13 also includes a generally rectangular plate 27 having a longitudinally extending upstanding portion 28 terminating in the elongated slot 25 and the enlarged opening 26. A hole 29 is provided adjacent each corner of the generally rectangular plate 27 (as shown in FIG. 2) to receive a screw 30 (as shown in FIG. 1) for attaching the slide bracket 13 to the door 14. The chain lock assembly 10 can therefore be utilized for securing a door in a partially open position at selected times in a conventional manner.

Figure 3:
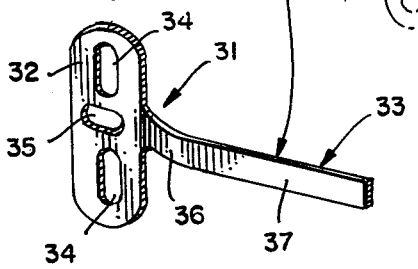
FIG. 3 is a perspective view of the bolt retention means illustrated in FIG. 2.

Referring to FIG. 3, the present invention includes a novel bolt retention means 31. The bolt retention means 31 includes a base member 32 and a resilient finger member 33. A conventional chain lock assembly 10 can utilize the bolt retention means 31 to prevent unauthorized entry by intruders in the manner described below.

The base member 32 of the bolt retention means 31 preferably includes a pair of longitudinally extending slots 34 and a slot 35 transverse thereto. The slots 34 are provided in the base member 32 to register with the holes 29 (as shown in FIG. 2) in the corners of the generally rectangular plate 27 of the slide bracket 13 near the end of the elongated slot 25 adjacent the enlarged opening 26. The slots 34 are therefore adapted to receive the screws 20 passing through the holes 29 to attach the bolt retention means 31 to the door 14. The transverse slot 35 is provided to accommodate conventional chain lock assemblies utilizing screws at the ends of the slide bracket rather than at the corners in order to provide maximum adaptability of the bolt retention means 31. It is within the contemplation of the present invention, however, to provide a single longitudinally extending slot in the base member 32 to accommodate both types of conventional chain lock assemblies for attaching the novel bolt retention means 31 of the present invention to a door.

The resilient finger member 33 of the bolt retention means 31 is preferably integral with the base member 32 extending away from the enlarged opening 26 into the elongated slot 25 and material such as spring steel is preferably utilized for reasons which will become apparent below. A slight bend is advantageously provided in the resilient finger member 33 (as shown in FIGS. 2 and 4) to include a first portion 36 extending away from the opening 26 into the slot 25 and a second portion 37 extending along the slot 25. The second portion 37 of the resilient finger member 33 can advantageously protrude just above the slot 25 to provided added assurance against unauthorized disengagement of the bolt 17 from the slide bracket 13.

The novel bolt retention means 31 of the present invention can quickly be installed for use with any conventional chain lock assembly presently mounted on a door in a manner of minutes by simply removing and replacing two screws. The screws 30 in the corners of the generally rectangular plate 27 near the end of the elongated slot 25 adjacent the enlarged opening 26 are removed and the screws 30 in the corners at the opposite end are loosened. The end of the plate 27 with the screws removed is then raised slightly and the bolt retention means 31 is inserted beneath the slide bracket 13 with the resilient finger member 33 raised away from the door 14. The screws 30 which have only been loosened are then tightened after the slots 34 in the base member 32 are made to register with the holes 29 and the second portion 37 of the resilient finger member 33 is centered and made to protrude just above the slot 25. The screws 30 which have been removed are then passed through the holes 29 and the slots 34 and tightened for attaching the bolt retention means 31 as well as the slide bracket 13 to the door 14.

The conventional chain lock assembly 10 with the bolt retention means 31 installed is ready for use in securing a door in a partially open position without the risk of unauthorized entry by intruders. The bolt 17 can easily be inserted into position in the regular manner described above. As the disc 20 of the bolt 17 remote from the terminal link 18 slides behind the elongated slot 25 it will slightly depress the resilient finger member 33 until it passes beyond the end of the second portion 37 at which time the resilient finger member 33 will spring back into position just above the slot 25. The bolt 17 cannot thereafter be moved back along the slot 25 into the enlarged opening 26 by means of a wire or other tools commonly used by intruders since the bolt retention means 31 will block its movement in this direction. However, the bolt 17 is easily disengaged rom the slide bracket 13 by the occupants by simply depressing the resilient finger member 33 (as shown in phantom in FIG. 4) toward the door 14 and sliding the bolt 17 along the slot 25 into the opening 26.

A conventional chain lock assembly is most useful for securing a door in a partially open position but such assemblies have suffered the disadvantage of failing to keep out skilled intruders. The unauthorized entry of skilled intruders into rooms, apartments, or homes while the occupants are inside has been a relatively simple matter by using wires, magnets and hasps to slip the bolt of the conventional chain lock assembly. The bolt retention means of the present invention is designed to keep the intruder out by blocking the normal sliding action of the bolt. The present invention provides a simple, inexpensive device which can quickly and easily be installed beneath all conventional chain lock assemblies.

While in the foregoing specification a detailed description of the invention has been set forth for the purpose of illustration, variations of the details herein given may be made by those skilled in the art without departing from the spirit and scope of the invention.

I claim:

1. A chain lock assembly for securing a door in a partially open position including a keeper bracket for attachment to a door frame, a chain having one end secured to said keeper bracket, a bolt connected to the other end of said chain, and a slide bracket for attachment to said door having an elongated slot for slidably receiving said bolt with said elongated slot having an enlarged opening in one end thereof to facilitate introducing said bolt into said elongated slot, said slide bracket further having a generally rectangular plate with a longitudinally extending upstanding portion terminating in said elongated slot and said enlarged opening, said generally rectangular plate having a hole provided adjacent each corner thereof to receive a screw for attaching said slide bracket to said door, wherein the improvement comprises a bolt retention means including a base member adjacent said enlarged opening and a resilient finger member integral with said base member extending away from said enlarged opening into said elongated slot to prevent disengagement of said bolt from said slide bracket, said base member being provided with a slot to register with each of said holes in the corners of said generally rectangular plate near the end of said elongated slot adjacent said enlarged opening to receive said screws for attaching said bolt retention means to said door.

2. The chain lock assembly of claim 1 in which said resilient finger member of said bolt retention means is slightly bent with a first portion extending away from said enlarged opening into said elongated slot and a second portion extending along and just above said elongated slot.

* * * * *